US008704741B2

(12) United States Patent
Mizusako et al.

(10) Patent No.: US 8,704,741 B2
(45) Date of Patent: Apr. 22, 2014

(54) LIQUID CRYSTAL DISPLAY, CONTROL METHOD THEREOF AND ELECTRONIC DEVICE FOR MINIMIZING FLICKER

(75) Inventors: Kazuhisa Mizusako, Chino (JP); Takashi Toyooka, Matsumoto (JP); Hitoshi Sasaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 979 days.

(21) Appl. No.: 12/792,946

(22) Filed: Jun. 3, 2010

(65) Prior Publication Data

US 2010/0309189 A1 Dec. 9, 2010

(30) Foreign Application Priority Data

Jun. 3, 2009 (JP) ..... 2009-133789

(51) Int. Cl.
*G09G 3/36* (2006.01)

(52) U.S. Cl.
USPC ..... 345/94

(58) Field of Classification Search
USPC ..... 345/87, 90, 94, 95, 98
See application file for complete search history.

(56) References Cited

U.S. PATENT DOCUMENTS

| | | | | |
|---|---|---|---|---|
| 5,754,154 | A | 5/1998 | Katakura et al. | |
| 5,940,055 | A * | 8/1999 | Lee | 345/87 |
| 6,771,245 | B2 | 8/2004 | Kanbe et al. | |
| 2005/0156846 | A1 * | 7/2005 | Odake et al. | 345/94 |
| 2007/0164963 | A1 * | 7/2007 | Kim et al. | 345/98 |

FOREIGN PATENT DOCUMENTS

| | | |
|---|---|---|
| JP | 06-347759 | 12/1994 |
| JP | 2002-189460 | 7/2002 |

* cited by examiner

*Primary Examiner* — Chanh Nguyen
*Assistant Examiner* — Ram Mistry
(74) *Attorney, Agent, or Firm* — Maschoff Brennan

(57) ABSTRACT

A liquid crystal display, applying to the first electrode, a voltage higher and a voltage lower at different timings, detecting a current flowing through the second electrode, designating, as a reference value, the current flowing through the second electrode when the voltage maintained in the liquid crystal element is reset, specifying a first current which is obtained by excluding a charging current due to application of a related higher voltage from currents flowing through the second electrode after the higher voltage is applied to the first electrode, and a second current which is obtained by excluding a charging current due to application of a related lower voltage from currents flowing through the second electrode after the lower voltage is applied to the first electrode, and comparing the first current with the second current, and controlling the first current and the second current based on the comparison result.

8 Claims, 12 Drawing Sheets

SCANNING LINE DRIVING CIRCUIT

DATA LINE DRIVING CIRCUIT

<DETECTION ADJUSTMENT MODE (ZERO POINT DETECTION)>

SCANNING LINE DRIVING CIRCUIT

DATA LINE DRIVING CIRCUIT

COMMON SIGNAL CURRENT WAVEFORM

SCANNING LINE DRIVING CIRCUIT

DATA LINE DRIVING CIRCUIT

COMMON SIGNAL CURRENT WAVEFORM

<DETECTION ADJUSTMENT MODE (CURRENT INTEGRAL)>
FRAME PERIOD
P
N
G1
G2
G3
G4
G767
G768
Frp
VH
VL
(POSITIVE WRITING)
(NEGATIVE WRITING)

SCANNING LINE DRIVING CIRCUIT d1 TO d1024 (ds)
DATA LINE DRIVING CIRCUIT
Vc
VH
Vw (+)
Vg (+)
Vb (+)
Vb (-)
Vg (-)
Vw (-)
VL

COMMON SIGNAL CURRENT WAVEFORM
Ip
In
0
Ta
Ta
PRECEDING
DELAYING
P
N

Vc
Vcom

SCANNING LINE DRIVING CIRCUIT

DATA LINE DRIVING CIRCUIT

COMMON SIGNAL CURRENT WAVEFORM

LIQUID CRYSTAL DISPLAY, CONTROL METHOD THEREOF AND ELECTRONIC DEVICE FOR MINIMIZING FLICKER

BACKGROUND

1. Technical Field

The present invention relates to a technique which prevents application of a direct current component or the like in a liquid crystal display.

2. Related Art

Liquid crystal elements, which can be used in a liquid crystal display ("LCD"), enable a liquid crystal layer to be sandwiched by two electrodes, but the liquid crystal layer is deteriorated if a direct current ("DC") component is applied to liquid crystal. For this reason, in the LCD, alternating current ("AC") driving is generally performed. A technique is known in which since even the AC driving sometimes cannot prevent the application of the DC component to the liquid crystal layer, a voltage applied to one electrode of the liquid crystal element is set to be a corrected voltage so that flicker is minimized, that is, so that a difference between transmittance (brightness) due to application of a positive voltage and that due to application of a negative voltage is minimized (refer to FIG. 6 in JP-A-2002-189460 which is an example of related art).

However, the setting of only the corrected voltage for minimizing flicker sometimes cannot also prevent the application of the DC component to the liquid crystal element.

SUMMARY

An advantage of some aspects of the invention is to provide a technique capable of preventing application of a DC component to a liquid crystal layer with more accuracy.

A liquid crystal display according to an embodiment of the invention includes, a liquid crystal element in which a liquid crystal layer is sandwiched by a first electrode and a second electrode; a driving circuit configured to apply, between the first electrode and the second electrode, a voltage for resetting a voltage maintained in the liquid crystal element and thereafter to apply, to the first electrode, a voltage higher than a predetermined voltage and a voltage lower than the predetermined voltage at different timings; a detection circuit configured to detect a current flowing through the second electrode; a comparison circuit configured to designate, as a reference value, the current flowing through the second electrode when the voltage maintained in the liquid crystal element is reset, to specify a first current which is obtained by excluding a charging current due to application of a related higher voltage from currents flowing through the second electrode when the higher voltage is applied to the first electrode, and a second current which is obtained by excluding a charging current due to application of a related lower voltage from currents flowing through the second electrode when the lower voltage is applied to the first electrode, and to compare the first current with the second current; and a control circuit configured to control the first current and the second current based on the comparison result. According to the invention, it is possible to suppress application of a DC component to the liquid crystal layer with more accuracy, without employing a light sensing element. Also, it is possible to reduce flicker.

When the driving circuit applies the same voltage to the first electrode and the second electrode, as the voltage for resetting a voltage maintained in the liquid crystal element, a reference value for a current may be simply obtained.

Further, the control circuit may specify, as the first current or the second current, a current flowing through the second electrode after a predetermined time has elapsed since the higher voltage or the lower voltage is applied. It is possible to increase detection accuracy by excluding an influence of the charging current from the currents flowing through the liquid crystal element.

In this case, the first electrode may be a pixel electrode which is coupled to a data line, via a switching element turned on when a scanning line is selected, and the second electrode may be a common electrode, wherein the driving circuit may include a scanning line driving circuit selecting the scanning line; a data line driving circuit supplying a data signal for the data line at the selection period; and a common electrode driving circuit supplying the common voltage for the common electrode.

In this configuration, the control circuit may increase or decrease the common voltage based on the comparison result for the positive current and the negative current.

Also, in this configuration, the control circuit may alter a duration where the higher voltage is maintained in the pixel electrode and a duration where the lower voltage is maintained in the pixel electrode based on the comparison result.

Also, in this configuration, the comparison circuit may compare an integral value for the first current with an integral value for the second current.

The detection circuit may include a resistor interposed in a signal line transmitting the predetermined voltage to the second electrode; and a voltage amplification circuit amplifying a voltage across the resistor, and the detection circuit may detect the voltage amplified by the voltage amplification circuit as the current flowing through the second electrode.

In addition, the detection circuit may detect a current flowing through the second electrode of the liquid crystal element placed in an area other than a display area. When the detection is performed by using the liquid crystal element placed in the area other than the display area, a display due to the voltage application by the driving circuit is not recognized.

In addition, the invention is not limited to the liquid crystal display, but is applicable to a control method of the liquid crystal display, and also to an electronic device having the liquid crystal display.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described with reference to the accompanying drawings.

First Embodiment

Figure 1:
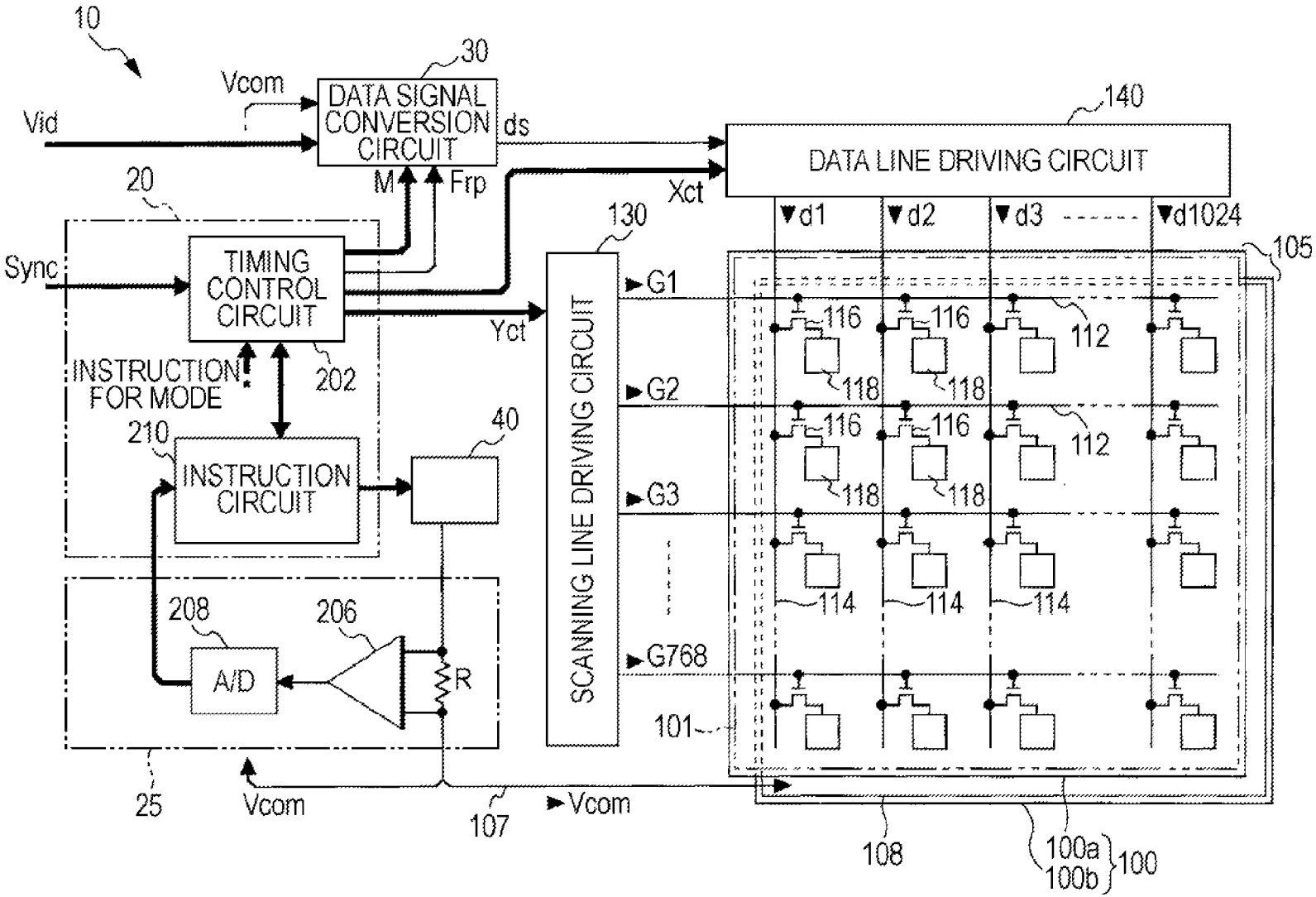
FIG. 1 is a block diagram illustrating a configuration of a liquid crystal display according to a first embodiment.

To begin with, a first embodiment of the invention will be described. FIG. 1 is a block diagram illustrating an entire configuration of a liquid crystal display ("LCD") according to the first embodiment.

As shown in this figure, an LCD 10 includes a control circuit 20, a detection circuit 25, a data signal conversion circuit 30, a common electrode driving circuit 40, a panel assembly 100, a scanning line driving circuit 130, and a data line driving circuit 140.

The LCD 10 has two operation modes, a display mode where the panel assembly 100 performs a display operation based on a video signal Vid supplied from an external device (not shown), and a detection adjustment mode where a current zero reference value is detected and also a voltage applied to liquid crystal elements is adjusted to suppress application of a DC component to the liquid crystal layer.

The operation mode is in principle set to the display mode, but on exceptional occasions is transferred to the detection adjustment mode, for example, in a sequence immediately after the LCD is turned on or immediately before it is turned off. Also, it is expected that the display mode is forced to be transferred to the detection adjustment mode after a predetermined time has elapsed in the detection adjustment mode, and, when an operation section is disposed and a user operates the operation section, it is transferred to the detection adjustment mode.

For either of these, in the LCD 10, according to the operation mode instructed by an external device or an operation of the operation section, the detection adjustment mode is executed and the control circuit 20 (a timing control circuit 202) controls the respective elements.

For convenience of description, a configuration of the panel assembly 100 will be described. The panel assembly 100 has an element panel 100*a* and an opposite panel 100*b*, which are attached to each other with a constant gap therebetween, and a liquid crystal layer 105 is sealed in the gap.

On a plane of the element panel 100*a* opposite to the opposite panel 100*b*, scanning lines 112 of 768 rows are arranged extending in the transverse direction in the figure and data lines 114 of 1024 columns are arranged extending in the longitudinal direction therein, which are provided so as to be electrically insulated with the respective scanning lines 112.

In order to distinguish scanning lines 112 from each other, they are hereinafter also referred to as scanning lines in the 1st, 2nd, 3rd, . . . , and 768th row from the top in the figure. In the same manner, in order to distinguish the data lines 114 from each other, they are also referred to as data lines in the 1st, 2nd, 3rd, . . . , and 1024th column from the left in the figure.

The element panel 100*a* is provided with plural sets of n channel thin film transistors (hereinafter, abbreviated to "TFTs") 116 which function as switching elements, and pixel electrodes 118 which function as the first electrodes and are transparent with a tetragonal shape, at the respective intersections of the scanning lines 112 and the data lines 114. Gate electrodes of the TFTs 116 are connected to the scanning lines 112, source electrodes thereof to the data lines 114, and drain electrodes thereof to the pixel electrodes 118.

On a plane of the opposite panel 100*b* opposite to the element panel 100*a*, common electrodes 108, which function as the second electrodes and are transparent, are provided to be opposite to the pixel electrodes 118.

The scanning lines 112, the data lines 114, the TFTs 116, and the pixel electrodes 118 are actually placed on the rear face of the element panel 100*a* in FIG. 1 and thus they are marked with broken lines, but, for easy recognition, they are marked with the solid lines.

Figure 2:
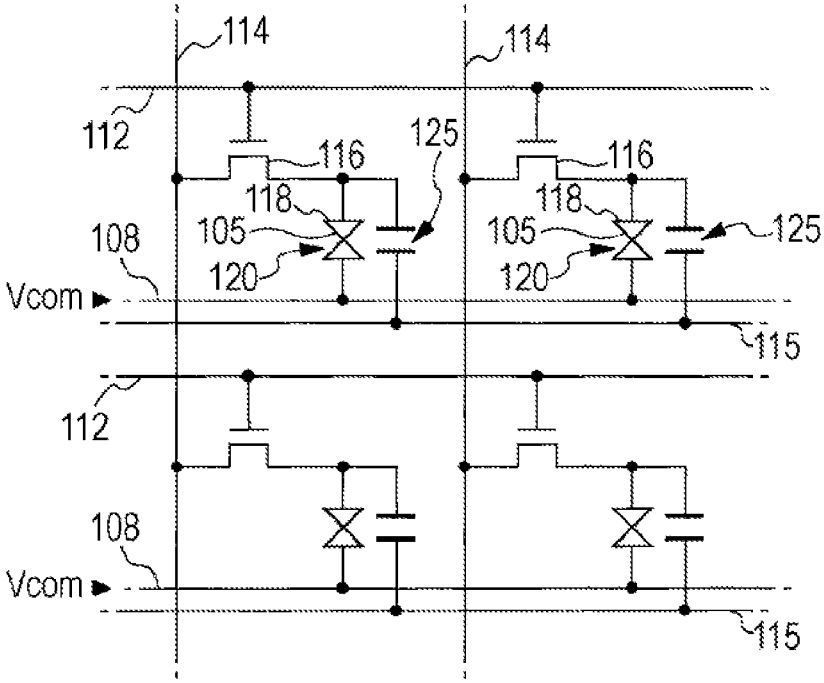
FIG. 2 is a diagram illustrating a configuration of pixels in the same liquid crystal display.

The equivalent circuit for the panel assembly 100 is as shown in FIG. 2, and the liquid crystal elements 120 are provided at the intersections of the scanning lines 112 and the data lines 114, and enables the liquid crystal layer 105 to be sandwiched by the pixel electrodes 118 and the common electrodes 108.

In each of the liquid crystal elements 120, a voltage between the pixel electrode 118 and the common electrode 108 is maintained, and a molecule arrangement of the liquid crystal layer 105 is varied depending on the electric field generated by both the electrodes. Thereby, the liquid crystal element 120, if it is of a transmissive type, shows transmittance corresponding to a voltage which is applied and maintained.

The transmittance is varied in each liquid crystal element 120 in the panel assembly 100, and hence the liquid crystal element 120 corresponds to a pixel. An area where these pixels are arranged is a display area 101.

Although not shown in FIG. 1, the equivalent circuit for the panel assembly 100 actually includes auxiliary capacitors (storage capacitors) 125 in parallel with the liquid crystal elements 120, as shown in FIG. 2. The respective auxiliary capacitors 125 have one end connected to the pixel electrodes 118 and the other end commonly connected to capacitance lines 115. The capacitance lines 115 are maintained to be a predetermined voltage which is temporally constant.

Here, in the display mode, the scanning lines are selected in a predetermined order, and selection voltages are applied to the selected scanning lines, thereby turning on the TFTs 116 in the selected scanning lines 112. Data signals with voltages corresponding to desired grayscales are supplied for the liquid crystal elements 120 related to the selected scanning lines 112 via the data lines 114, and the associated data signals are applied to the pixel electrodes 118 via the turned-on TFTs 116. Thereby, the liquid crystal elements 120 are applied with voltages corresponding to differences between the voltages applied to the pixel electrodes 118 and the common electrodes 108.

Even when the TFTs 116 are turned off due to the application of non-selection voltages to the scanning lines, the voltages applied to the liquid crystal elements 120 when the TFTs 116 are turned on are maintained due to their capacitive characteristics.

The data signals with the voltages corresponding to the grayscales are supplied for the liquid crystal elements 120 placed in the selected scanning lines via the data lines 114, and thereby the associated pixels are made to represent desired transmittances.

In addition, in this embodiment, the liquid crystal elements 120 have a normally black mode where the transmittance is increased as the maintained voltage is heightened.

In order to prevent a DC component from being applied to the liquid crystal layer 105, for the voltage of the data signal, a voltage (higher voltage) with positive polarity higher than a video amplitude central voltage (predetermined voltage) Vc, which is a reference voltage, and a voltage (lower voltage) with negative voltage lower than that, may be alternately switched, for example, for each frame period. This reference voltage Vc is fixed, whereas the common voltage Vcom applied to the common electrode 108 is adjusted in the detection adjustment mode. In addition, the common voltage Vcom is set to a predetermined value (a slightly lower voltage than the reference voltage Vc) at the initial step.

Also, the frame period refers to a period needed to display an amount of one frame of images when the panel assembly 100 is driven in the display mode, and, if a vertical synchronization frequency defined in a vertical synchronization signal is 60 Hz, it is 16.7 ms which corresponds to a reciprocal thereof.

For the applied to and maintained voltage in the liquid crystal element 120, a voltage difference between the pixel electrode 118 and the common electrode 108 is mentioned, but, for a voltage such as a voltage across a resistor R described later or the like, as long as it is not particularly referred to, a ground voltage of a power supply (not shown) is a reference for a voltage zero.

In the display mode, for a spatial arrangement of polarity written in the pixels during one frame period, in this embodiment, the same written polarity is designated for all the pixels over the same frame period, and also a frame inversion method is employed where the written polarity is reversed every frame period. In addition to the frame inversion method, there are a row inversion method of reversing the written polarity every scanning line, a column inversion method of reversing it every data line, a pixel inversion method of reversing it every pixel neighboring in the scanning line and the data line directions, and so on, but the invention is applicable to any inversion methods.

In addition, this LCD 10 is supplied with a digital video signal Vid from an external device (not shown). This video signal Vid is digital data for allocating brightness (grayscale) to each pixel in the panel assembly 100, and is supplied for each pixel in an order scanned based on synchronization signals Sync (vertical synchronization signal, horizontal synchronization signal and dot clock signal).

The data signal conversion circuit 30 outputs a data signal ds in response to an operation mode instructed by the timing control circuit 202. In detail, the data signal conversion circuit 30, in the display mode, converts the digital video signal Vid into an analog data signal ds with polarity designated by a signal Frp relative to the reference voltage Vc, and, in the detection adjustment mode, it outputs a voltage signal according to operation steps described later, as the data signal ds.

The common electrode driving circuit 40 is, for example, a D/A conversion circuit or the like, and applies the common voltage Vcom to the common electrode 108 via the signal line 107. Here, the common electrode driving circuit 40, in the detection adjustment mode, increases or decreases the common voltage Vcom by one step (for example, 0.05V) in response to an instruction from an instruction circuit 210, and, in the display mode, it maintains a voltage which has been set finally in the detection adjustment mode.

The control circuit 20 includes the timing control circuit 202 and the instruction circuit 210. Of the two, according to the operation mode, the timing control circuit 202 controls each of the data signal conversion circuit 30, the scanning line driving circuit 130, the data line driving circuit 140, and the instruction circuit 210. Control contents of the timing control circuit 202 will be described in detail in its operation.

The instruction circuit 210 includes, for example, a programmable logic circuit or the like, and, in the display mode, it hardly performs characteristic operations. However, in the detection adjustment mode, it determines a positive current value (first current value) and a negative current value (second current value) based on the supplied digital data, and gives an instruction based on its result to the common electrode driving circuit 40. The positive current value, the negative current value, and an operation of the instruction circuit 210 will be described later in detail.

A detection circuit 25 includes a resistor R, a voltage amplification circuit 206, and an A/D conversion circuit 208. Among these, the resistor R is interposed in the signal line 107. Thereby, a voltage proportional to a current flowing through the signal line 107 is developed across the resistor R.

The voltage amplification circuit 206 is constituted by an operational amplifier or the like and amplifies a voltage across the resistor R with a predetermined gain. The A/D conversion circuit 208 converts the voltage detected and amplified by the voltage amplification circuit 206 into digital data for output to the instruction circuit 210. In addition, a sampling rate (sampling frequency) in the A/D conversion circuit 208 is set to a sufficiently high value relative to the variation of the voltage detected and amplified by the voltage amplification circuit 206.

Next, an operation of the LCD will be described.

To begin with, an operation in the display mode will be described. In the display mode, the timing control circuit 202 controls the respective elements in response to the synchronization signals Sync supplied from an external device.

Figure 3A:
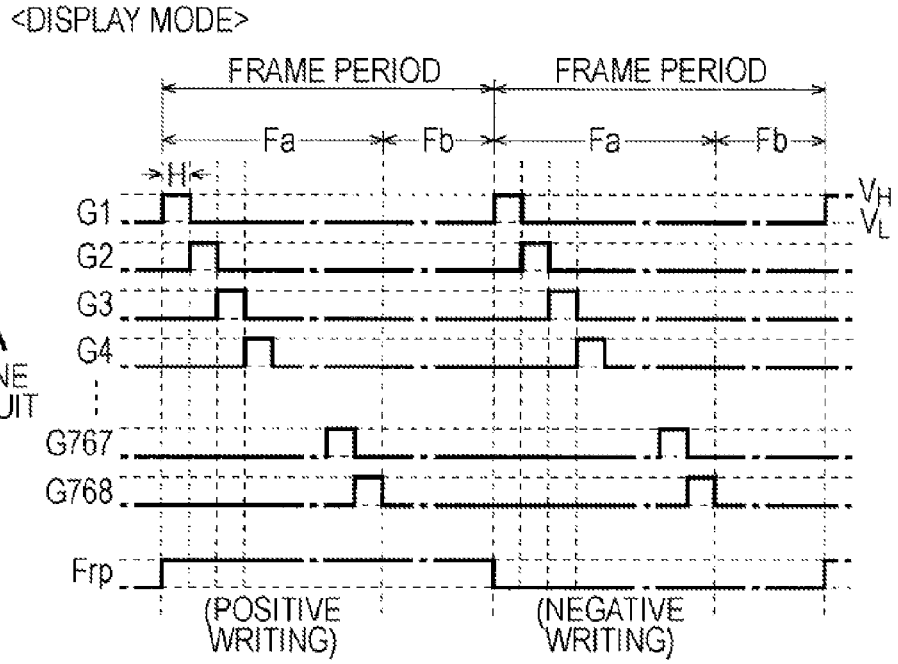
FIGS. 3A and 3B are diagrams illustrating an operation in a display mode in the same liquid crystal display.

In detail, the timing control circuit 202, in the display mode, controls the scanning line driving circuit 130 using a control signal Yct so that the scanning lines 112 are selected sequentially one by one every horizontal scanning period from a start timing of the vertical scanning period (frame period) defined by the synchronization signals Sync. By this control, the scanning line driving circuit 130 performs a line sequential driving so that the respective scanning signals G1 to G768 exclusively become selection signals $V_H$ with a H level in their order every horizontal scanning period (H), as shown in FIG. 3A. In addition, L levels of the scanning signals correspond to non-selection voltages $V_L$. In the same figure, the reference sign Fa denotes a vertical valid scanning period, and, the reference sign Fb denotes a vertical blanking period.

Meanwhile, the timing control circuit 202 notifies the data signal conversion circuit 30 of the display mode using a control signal M and also supplies the signal Frp therefor. Here, the signal Frp designates polarity of the data signal ds, and, for example, its H level designates the positive polarity and its L level designates the negative polarity. Since this embodiment employs the frame inversion method, as described above, the logic level of the signal Frp is reversed every frame period.

The timing control circuit 202, in the display mode, controls the data line driving circuit 140 using a control signal Xct so that the data signal ds converted by the data signal conversion circuit during the horizontal scanning period is sampled in the data lines 114 in amount of one pixel in an order of 1, 2, 3, . . . , 1024 columns, from the start timing of the horizontal scanning period.

The video signal Vid is supplied in an order of 1 row by 1 column to 1 row by 1024 column, 2 row by 1 column to 2 row by 1024 column, 3 row by 1 column to 3 row by 1024 column, . . . , and 768 row by 1 column to 768 row by 1024 column, during one frame period.

Here, at a frame period where the positive polarity writing is designated when the signal Frp becomes the H level, during the horizontal scanning period when the video signal Vid for 1 row by 1 column to 1 row by 1024 column is supplied, the related video signal Vid is converted into the data signal ds with the positive polarity by the data signal conversion circuit 30, and, at the same time, the related data signal ds is sampled as data signals d1, d2, d3, . . . , d1024 in the data lines 114 in the 1st, 2nd, 3rd, . . . , and 1024th columns by the data line driving circuit 140.

In addition, during the related horizontal scanning period, only the scanning signal G1 becomes the H level by the scanning line driving circuit 130, and thereby the TFTs 116 in the first row are turned on. Thereby, the data signals sampled in the data lines 114 are applied to the pixel electrodes 118 via the turned-on TFTs 116, and in turn voltages, with positive polarity, corresponding to the grayscales are respectively written in the liquid crystal elements 120 in 1 row by 1 column to 1 row by 1024 column.

Subsequently, during the horizontal scanning period where the video signal Vid for 2 row by 1 column to 2 row by 1024 column is supplied, in the same manner, the related video signal Vid is converted into the data signal ds with positive polarity, and, at the same time, the related data signal ds is sampled in the data lines 114.

Meanwhile, since only the scanning signal G2 becomes the H level, the TFTs 116 in the second row are turned on. Thereby, the data signals sampled in the data lines 114 are applied to the pixel electrodes 118, and thus voltages, with positive polarity, corresponding to the grayscales are respectively written in the liquid crystal elements 120 in 2 row by 1 column to 2 row by 1024 column. Below a similar writing operation is performed according to the 3rd, 4th, . . . , 768th column.

During the following frame period, the signal Frp becomes the L level so that the negative writing is designated, and the same writing operation is repeated except for conversion of the video signal Vid into the data signal ds with negative polarity. Thereby, voltages, with negative polarity, corresponding to the respective grayscales, are written in the respective liquid crystal elements.

In the display mode, images corresponding to the video signal Vid are displayed on the panel assembly 100 by such voltage writing.

Figure 3B:
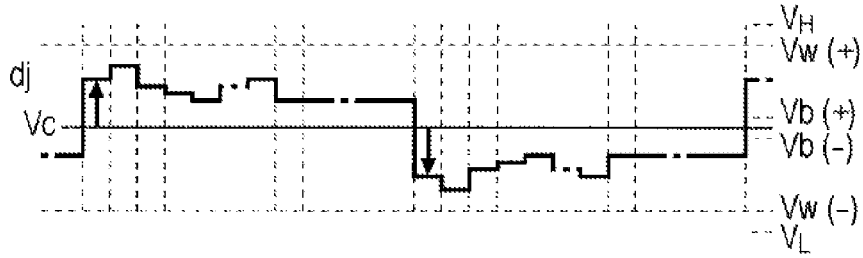

FIG. 3B shows a voltage variation in the data signal dj sampled in j-th data line 114, by using j (where j is 1 to 1024) for general description without specifying columns. In this embodiment, the liquid crystal elements 120 have the normally black mode, and thus, for example, at the horizontal scanning period where the scanning signal G1 becomes the H level, if the data signal dj is positive, it has a higher voltage than the reference voltage Vc by an amount corresponding to a grayscale for 1 row by j column (marked with ↑ in the figure), and if negative, it has a lower voltage than the reference voltage Vc by an amount of a grayscale for 1 row by j column (marked with ↓ in the figure).

For the voltages of the data signal, if the positive polarity is designated, they are deviated, by an amount corresponding to a grayscale, from the reference voltage Vc in a range from the voltage Vw(+) corresponding to the white to the voltage Vb(+) corresponding to the black. If the negative polarity is designated, they are deviated, by an amount corresponding to a grayscale, from the reference voltage Vc in a range from the voltage Vw(−) corresponding to the white to the voltage Vb(−) corresponding to the black. The voltage Vw(+) and the voltage Vw(−) are symmetric with respect to the reference voltage Vc. This is the same for the voltages Vb(+) and Vb(−).

The longitudinal scale for the voltage of the data signal in FIG. 3B is expanded compared with the voltage waveforms for the scanning signals in FIG. 3A.

In addition, in an ideal LCD, although flicker is generated due to application of a DC component to the liquid crystal layer 105, the common voltage Vcom is set to minimize flicker when the positive polarity and the negative polarity are alternately driven, and thereby the flicker is difficult to be generated since the application of a DC component to the liquid crystal layer 105 is minimized after such setting. However, in an actual LCD, as time goes by, there is a difference between electrical characteristics in the common electrode side and the pixel electrode side, or the like, and thereby a DC component is applied to the liquid crystal layer 105 to generate flicker again.

If there is a difference between the electrical characteristics in the common electrode side and the pixel electrode side, positive and negative voltages applied to and maintained in the liquid crystal elements 120 may be adjusted to remove the difference.

For this, a technique may also be considered in which a light sensing element is formed on the panel assembly or in the vicinity thereof, transmittances in the respective polarities are detected, and voltages applied to and maintained in the liquid crystal elements 120 are adjusted to remove the difference between the detected transmittances. However, if the light sensing element is formed, there are problems in that it has a negative influence on viewability of display images or a so-called frame is broadened, and there are also problems in that stray light inside the display device enters the light sensing element and thereby it is difficult to detect the transmittance accurately.

Figure 14A:
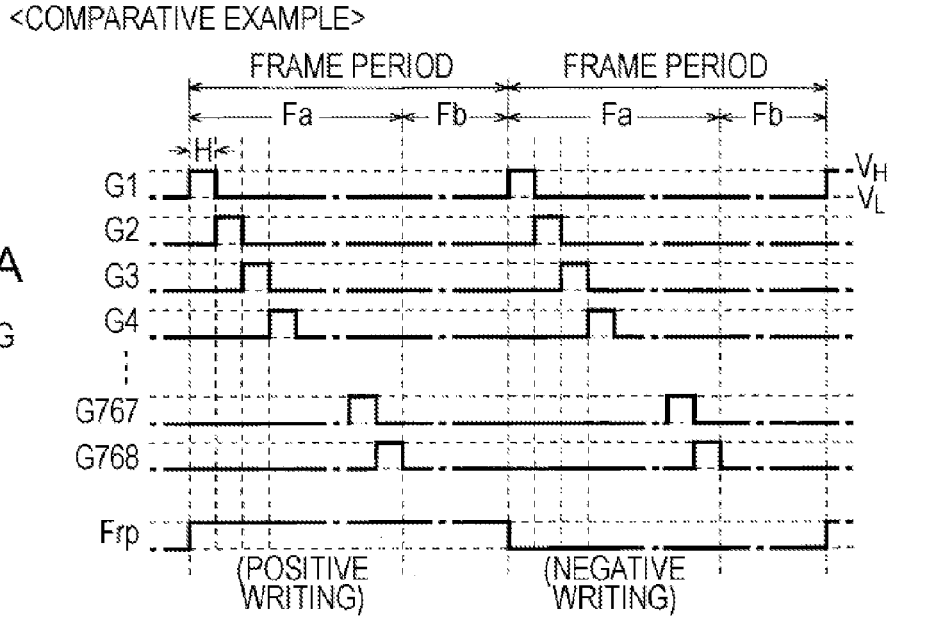
FIGS. 14A to 14C are diagrams illustrating an operation in a detection adjustment mode in a liquid crystal display according to a comparative example.
Figure 14B:
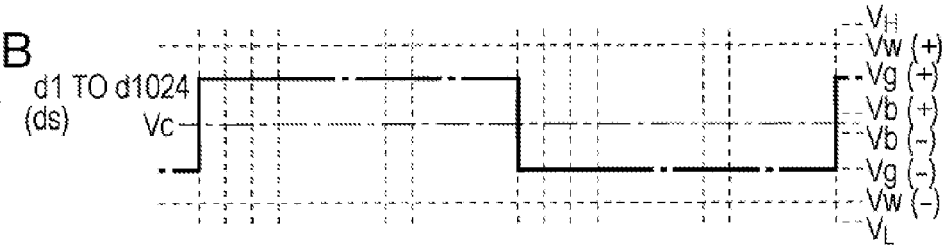
Figure 14C:
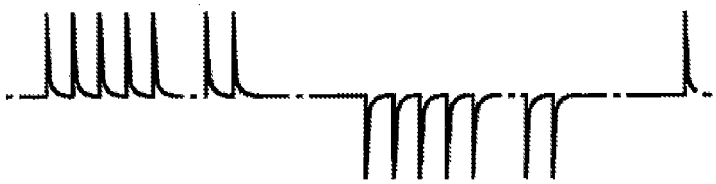

Such differences between the electrical characteristics in the common electrode side and the pixel electrode side is thought to be reflected on a current normally flowing through each liquid crystal element 120. However, the measurement of the current normally flowing through the liquid crystal element 120 is difficult for the following reasons. First, in the line sequential driving like in the display mode, the voltages are sequentially applied to the liquid crystal elements 120 by the row unit, and thus, as shown in FIG. 14, for the current flowing through the liquid crystal element, a current for charging the liquid crystal element is dominant and this makes it difficult to specify a small current flowing normally. Second, the current flowing through the liquid crystal element 120 is actually measured through amplification, but an offset happening at the time of the amplification has a negative influence on measurement accuracy in the positive and negative polarities.

For this reason, in this embodiment, the following detection adjustment mode is set independently from the display mode, and a small current normally flowing through the liquid crystal element 120 can be easily specified based on the detection adjustment mode. In addition, before specifying the small current, a reference value indicating current zero is obtained to exclude the influence of the offset, and the small current is specified by using the associated reference value.

Figure 4:
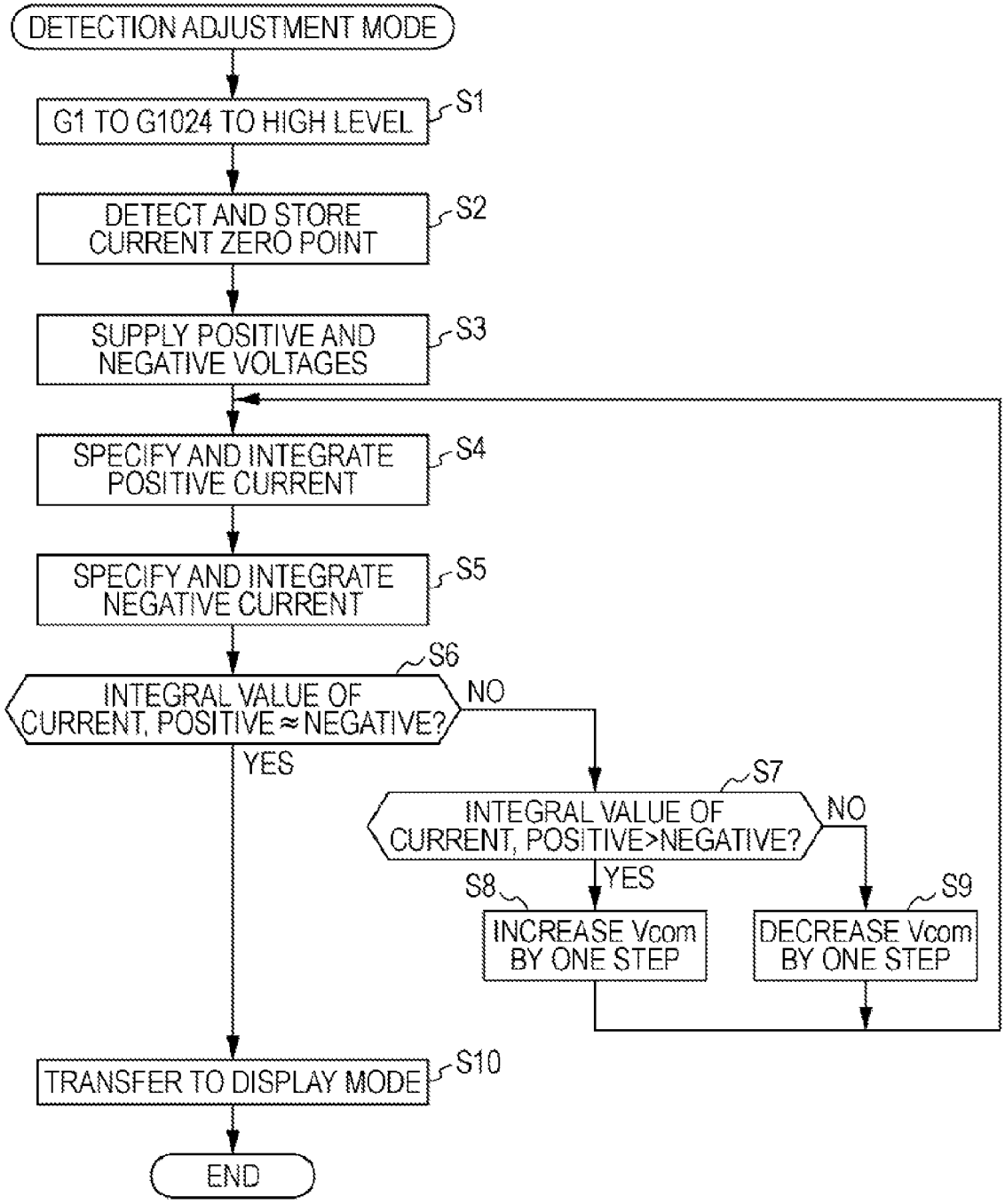
FIG. 4 is a flowchart illustrating an operation in a detection adjustment mode.

This detection adjustment mode will be described in detail. FIG. 4 is a flowchart illustrating operations by the respective elements of the control circuit 20 in the detection adjustment mode.

Figures 5A, 5B, 5C:
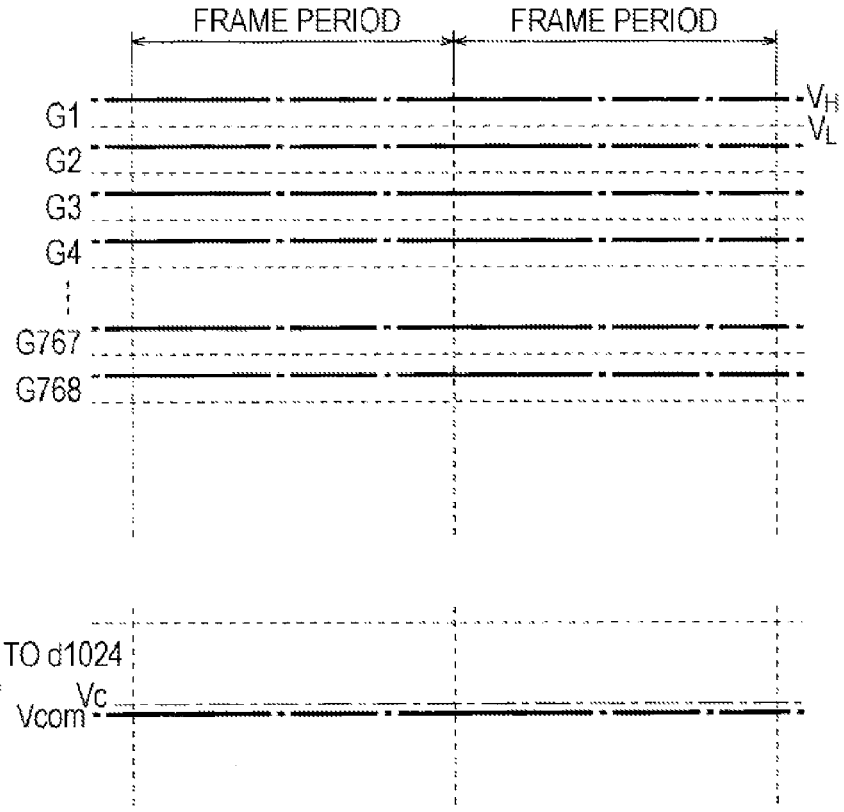
FIGS. 5A to 5C are diagrams illustrating zero point detection in the same detection adjustment mode.
Figure 6A:
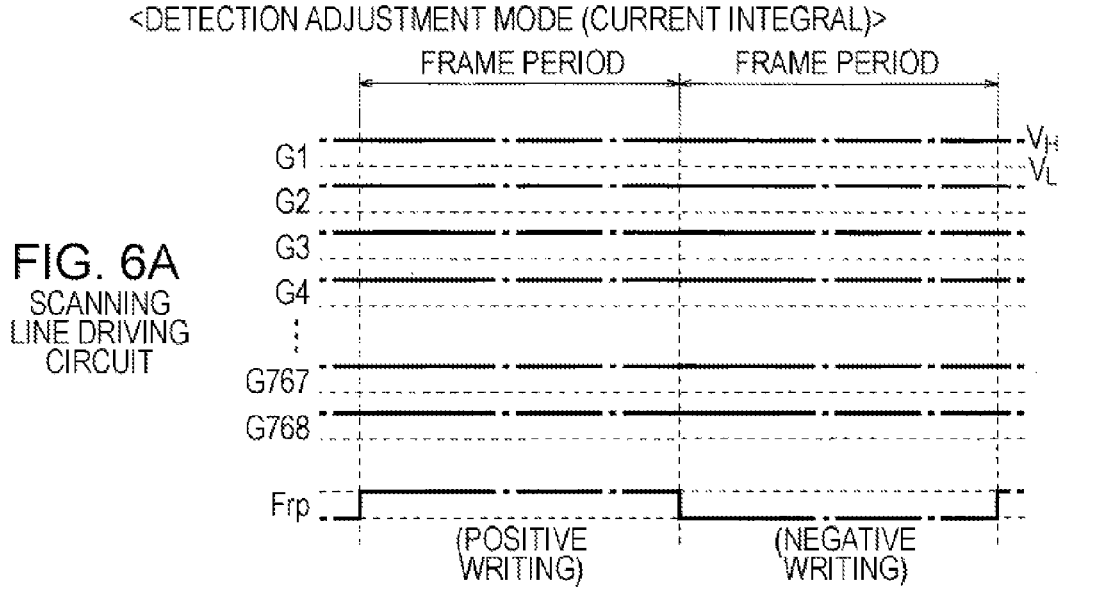
FIGS. 6A to 6C are diagrams illustrating an operation in the same detection adjustment mode.

To begin with, at step S1, the timing control circuit 202 of the control circuit 20 controls the scanning line driving circuit 130 using the control signal Yct so as to select all the scanning lines 112 irrespective of the synchronization signals Sync. Thereby, the scanning signals G1 to G768 become the selection voltage $V_H$ with the H level as shown in FIG. 5A and FIG. 6A, which corresponds to a frame sequential driving.

In order to obtain a current zero reference value, the timing control circuit 202 controls the respective elements as follows, at step S2. That is to say, first, the timing control circuit 202 controls the data signal conversion circuit 30 to select the common voltage Vcom output from the common electrode driving circuit 40, by using the control signal M. Thereby, the voltage of the data signal ds becomes the common voltage Vcom irrespective of the video signal Vid.

Second, the timing control circuit 202 controls the data line driving circuit 140 using the control signal Xct so that the data signal ds with the common voltage Vcom is supplied for all the data lines 114 collectively. Thereby, all the voltages of the data signals d1 to d1024 output from the data line driving circuit 140 become the voltage of the data signal ds, that is, the common voltage Vcom as shown in FIG. 5B.

In the panel assembly 100, all the scanning signals G1 to G768 are in the H level, and in turn all the TFTs 116 in all the rows by columns are turned on. Thereby, the common voltage Vcom is respectively supplied for all the pixel electrodes 118 collectively. Meanwhile, the common voltage Vcom is applied to the common electrode 108.

Therefore, the voltages applied to all the liquid crystal elements 120 (differences between voltages applied to the related pixel electrodes 118 and the voltage applied to the common electrode) are reset to zero, whereby a current flowing through the signal line 107 is also zero after sufficient time has elapsed since the application of the common voltage Vcom to the pixel electrodes 118, as shown in FIG. 5C.

If a current flows through the signal line 107, the current is converted into a voltage by the resistor R, amplified by the voltage amplification circuit 206, and then converted into digital data by the A/D conversion circuit 208 for output to the instruction circuit 210.

As described above, a current to be measured, that is, a current normally flowing through the signal line 107 is small. Also, this small current alters its direction at the time of applying a positive voltage and a negative voltage to the pixel electrodes 118, and thus the voltage amplification circuit 206 constituted by an operational amplifier or the like is significantly influenced by the offset. In addition, there may be cases where conversion error in the A/D conversion circuit 208 is difficult to ignore.

Thus, at step S2, a current flowing through the signal line 107 is made to be zero, and the instruction circuit 210 stores, in its memory, a value indicated by the digital data output from the A/D conversion circuit 208 at this time as the current zero reference value (more accurately, a voltage value corresponding to current zero).

The instruction circuit 210 which has stored the current zero reference value notifies this to the timing control circuit 202.

The timing control circuit 202, which receives the notification indicating that the current zero reference value is stored in the instruction circuit 210, supplies a signal Frp of which logic levels are reversed every frame period like in the display mode, for the data signal conversion circuit 30, at step S3. The data signal conversion circuit 30 designates the voltage of the data signal ds, as a positive intermediate grayscale voltage Vg(+) if the signal Frp is in the H level, and a negative intermediate grayscale voltage Vg(−) if the signal Frp is in the L level, irrespective of the video signal Vid.

Figure 6B:
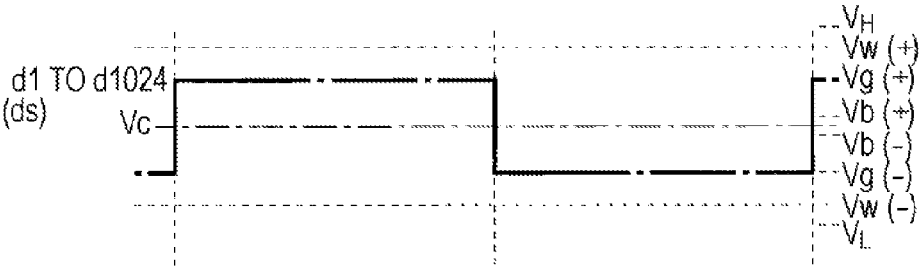

The timing control circuit 202 continues to control the scanning line driving circuit 130 to select all the scanning lines 112 and the data line driving circuit 140 to collectively supply the data signal ds for all the data lines 114. Thereby, the data signals d1 to d1024 by the data line driving circuit 140 are all the same as the data signal ds as shown in FIG. 6B and in turn become the voltage Vg(+) during the frame period where the signal Frp is in the H level and the voltage Vg(−) during the frame period where the signal Frp is in the L level. The voltages Vg(+) and Vg(−) are voltages corresponding to an intermediate grayscale between the white and the black, and they are symmetric with respect to the voltage Vc.

The instruction circuit 210 of the control circuit 20 performs the following operation at step S4 so as to find out an integral value for a positive current normally flowing through the liquid crystal elements 120 at the duration where the voltage Vg(+) is being applied to the pixel electrodes 118.

Figure 6C:
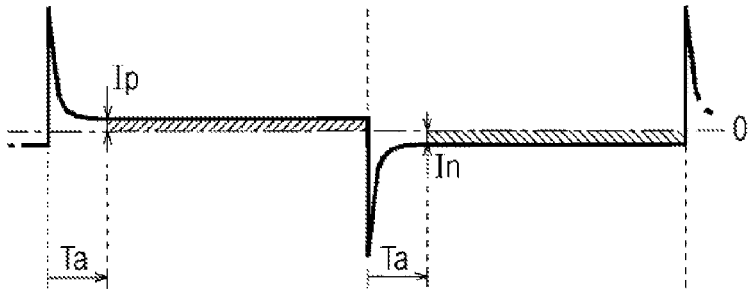

In other words, the instruction circuit 210, as shown in FIG. 6C, determines a positive current Ip obtained by subtracting the current zero reference value (voltage value) stored at step S3 from a current waveform value (voltage waveform value) indicated by the digital data which is input in time series during the frame period where the signal Frp is in the H level. Further, it integrates the corresponding current for an interval from a point in time when the time Ta has elapsed since the signal Frp is changed to be in the H level, to a point in time when the signal Frp is changed to be in the L level.

The integral value obtained in this way corresponds to an area of the zone marked with shading in this figure, and is a value which reflects the positive current normally flowing through the liquid crystal elements 120 at the duration where the voltage Vg(+) is being applied to the pixel electrodes 118.

Here, as the interval for integrating the current, the time Ta since the signal Frp is changed to be in the H level is excluded, and the reason is as follows. Although a current for charging all the liquid crystal elements 120 flows due to the application of the voltage Vg(+) to all the pixel electrodes 118 at a moment when the signal Frp is changed to be in the H level, the charging current is more dominant than the current normally flowing through the liquid crystal elements 120, that is, the current reflecting the difference between the electrical characteristics in the pixel electrode side and the common electrode side when the pixel electrode 118 is applied with a voltage higher than the common electrode 108. For example, if the charging current is about 5 mille ampere in magnitude, the current reflecting the characteristic difference is 1 micro ampere in magnitude, which is considerably small.

For this reason, in order to accurately measure the current reflecting the difference between electrical characteristics when the pixel electrode is applied with a higher voltage, the start point in the interval for integration of the current is designated as a point in time when the corresponding charging current is decreased to a degree capable of neglecting the influence thereof, that is, the point in time when the time Ta has elapsed since the signal Frp is changed to be in the H level from in the L level.

Likewise, the instruction circuit 210 of the control circuit 20, at step S5, performs the following operation so as to find out an integral value for a negative current normally flowing through the liquid crystal elements 120 at the duration where the voltage Vg(−) is being applied to the pixel electrodes 118. In other words, the instruction circuit 210, as shown in the same figure, determines a negative current In obtained by subtracting the current zero reference value (voltage value) from a current waveform value (voltage waveform value) indicated by the digital data which is input in time series during the frame period where the signal Frp is in the L level. Further, it integrates the corresponding current for an interval from a point in time when the time Ta has elapsed since the signal Frp is changed to be in the L level of, to a point in time when the signal Frp is changed to be in the H level.

For the end point in the current integral interval at steps S4 and S5, it is designated as the end point of the frame period, but a point in time is also possible which is before the end point of the frame period, which is a timing after a predetermined time has elapsed since the end point of the time Ta.

Next, the instruction circuit 210, at step S6, determines whether or not the integral value for the positive current and the integral value for the negative current lie in a range where they can be considered not to be different from each other, that is, determines whether or not a difference therebetween lies in a threshold value.

When the difference lies in the threshold value, it means that the common voltage Vcom is suitable at present, so, at step S10, the instruction circuit 210 sends to the timing control circuit 202 the notification indicating that it lies in the threshold value, and the timing control circuit 202 transfers the operation mode to the display mode.

Thereby, the detection adjustment mode is finished (there may be a case where the power can be turned off).

On the contrary, if the difference exceeds the threshold value, the instruction circuit 210, at step S7, determines whether or not the integral value for the positive current is greater than the integral value for the negative current.

Figure 7:
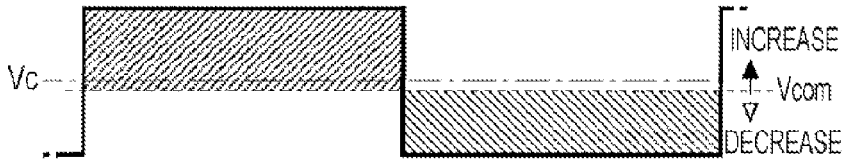
FIG. 7 is a diagram illustrating control for a common voltage.

When the integral value for the positive current is greater than the integral value for the negative current, it means that the positive voltage effective value is greater than the negative voltage effective value, due to the difference between the electrical characteristics in the common electrode side and the pixel electrode side. Thereby, at step S8, the instruction circuit 210 instructs the common electrode driving circuit 40 to increase the common voltage Vcom by one step. In response to this instruction, the common electrode driving circuit 40 increases the common voltage Vcom by one step as marked with the arrow directing upwards in FIG. 7, and hence works so that the positive voltage effective value is decreased and the negative voltage effective value is increased.

In addition, at step S7, when the integral value for the positive current is equal to or less than the integral value for the negative current, it means that since the difference lies in the threshold value has been already excluded at step S6, the integral value for the positive current is smaller than the integral value for the negative current, that is, the positive voltage effective value is smaller than the negative voltage effective value.

Thereby, at step S9, the instruction circuit 210 instructs the common electrode driving circuit 40 to decrease the common voltage Vcom by one step. In response to this instruction, the common electrode driving circuit 40 decreases the common voltage Vcom by one step as marked with the arrow directing downwards in FIG. 7, and hence works so that the positive voltage effective value is increased and the negative voltage effective value is decreased.

After the instruction at step S8 or S9, the process returns to step S4, and the processings at steps S4 to S9 are repeated until the difference between the integral value for the positive current and the integral value for the negative current lies in the threshold value.

If the processings at steps S4 to S9 are repeatedly performed, the difference between the integral value for the positive current and the integral value for the negative current finally lies in the threshold value, this causes the determination result at step S6 to be "Yes," and the operation mode is transferred to the display mode at step S10. Thereby, when transferred to the display mode after completion of the detection adjustment mode, the common voltage Vcom is controlled to be set to a voltage which enables the difference between the integral value for the positive current and the integral value for the negative current to lie in the threshold value in view of the absolute value, and thus flicker is reduced when transferred to the display mode because the application of a DC component to the liquid crystal layer 105 can be suppressed.

In this embodiment, in the detection adjustment mode, as to the finding of the current (integral value), the current flowing through the liquid crystal elements is first made to be zero, the reference value of digital data corresponding to the current zero is obtained and stored, and the small current normally flowing through the liquid crystal elements is measured with respect to the value for the current zero. Also, in the detection adjustment mode, as to the measurement of the minute current normally flowing through the liquid crystal elements, the liquid crystal elements 120 are driven based on the frame sequential driving unlike the display mode, this causes the influence of the charging current to appear only at the start timing of the frame period, and the small current normally flowing through the liquid crystal elements is measured at the point in time when its influence is sufficiently low. For this reason, according to an aspect of the invention, there can be an achievement of the effect of suppressing the application of a DC component to the liquid crystal layer 105 and reducing flicker with high accuracy, without employing a light sensing element for detecting transmittance or reflectance of the liquid crystal elements. Furthermore, the panel assembly 100 may adopt the product in the related art as it is.

A current flowing through a single liquid crystal element 120 is very small, but, in this embodiment, the integral value is determined based on the waveform of the current obtained by summing the total of the currents flowing through all the liquid crystal elements 120, and thus the detection accuracy can be increased. Here, there is no need of making currents flow through all the liquid crystal elements 120, for example, the scanning lines in odd rows are selected, and currents (or integral value) flowing through a half of the liquid crystal elements 120 may be determined.

In addition, although the integral values are compared with each other because this embodiment prioritizes the simplicity and the measurement accuracy, the current flowing for the duration from the start point of the frame period to the point in time after the time Ta has elapsed, reflects the difference between the electrical characteristics in the common electrode side and the pixel electrode side. Thereby, the currents Ip and In at this time may be detected and compared with each other.

Second Embodiment

The first embodiment increases or decreases the common voltage Vcom so that the positive voltage effective value and the negative voltage effective value in the liquid crystal elements 120 are equal to each other. The second embodiment applies each of the positive voltage and the negative voltage once to the pixel electrodes 118 of the respective liquid crystal elements 120, twice in total for a single frame period, and also controls a rate of a duration where the positive voltage is maintained and a duration where the negative voltage is maintained.

Figure 8:
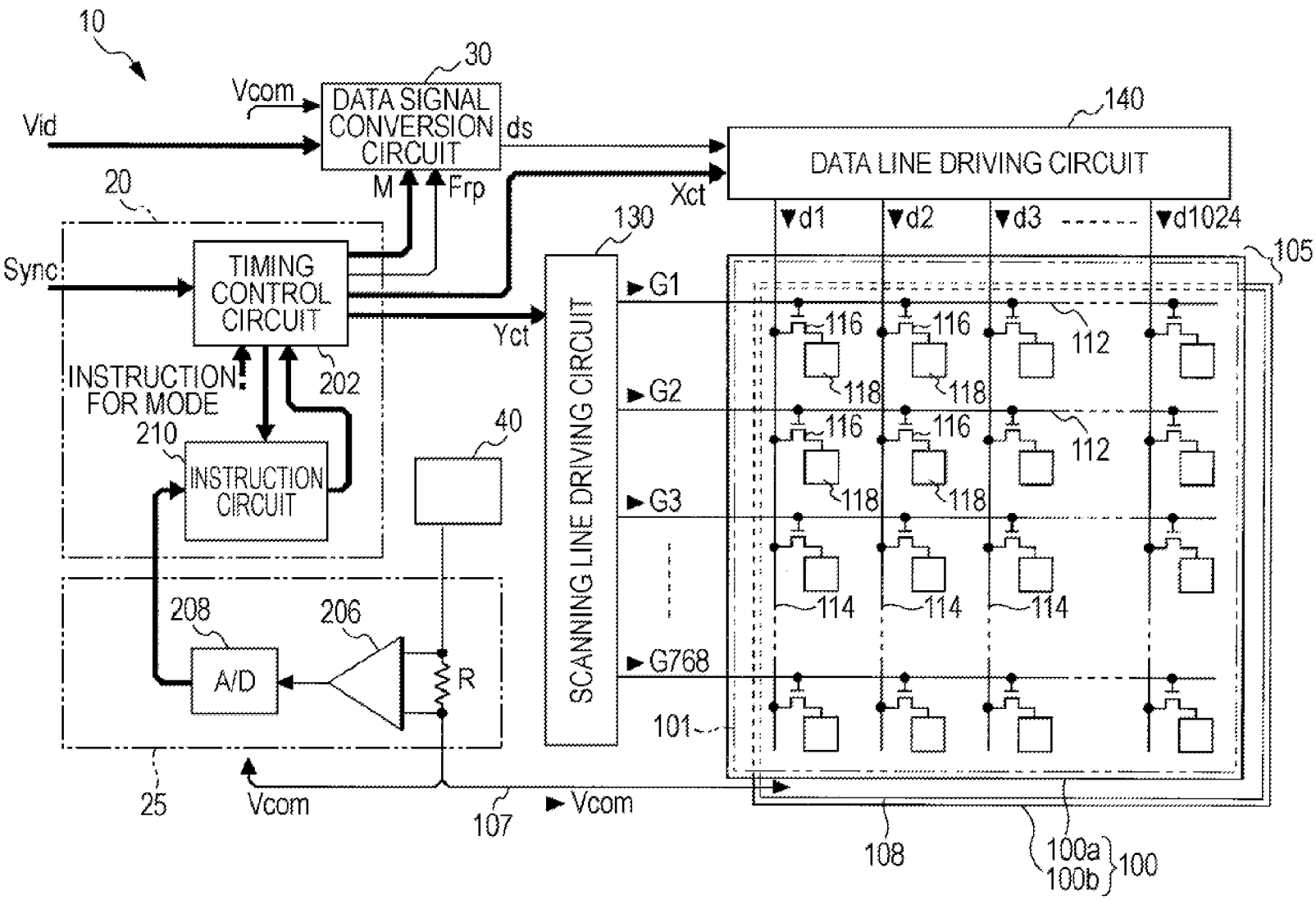
FIG. 8 is a diagram illustrating an operation in a display mode in a liquid crystal display according to a second embodiment.

FIG. 8 is a block diagram illustrating an entire configuration of an LCD according to a second embodiment. The LCD shown in this figure is different from one in the first embodiment in that the instruction circuit 210 instructs the timing control circuit 202, not the common electrode driving circuit 40, and also in a method that the scanning line driving circuit 130 selects the scanning lines.

Thereby, in the second embodiment, the common electrode driving circuit 40 does not increase or decrease the common voltage Vcom, which is thus constant.

Figure 9:
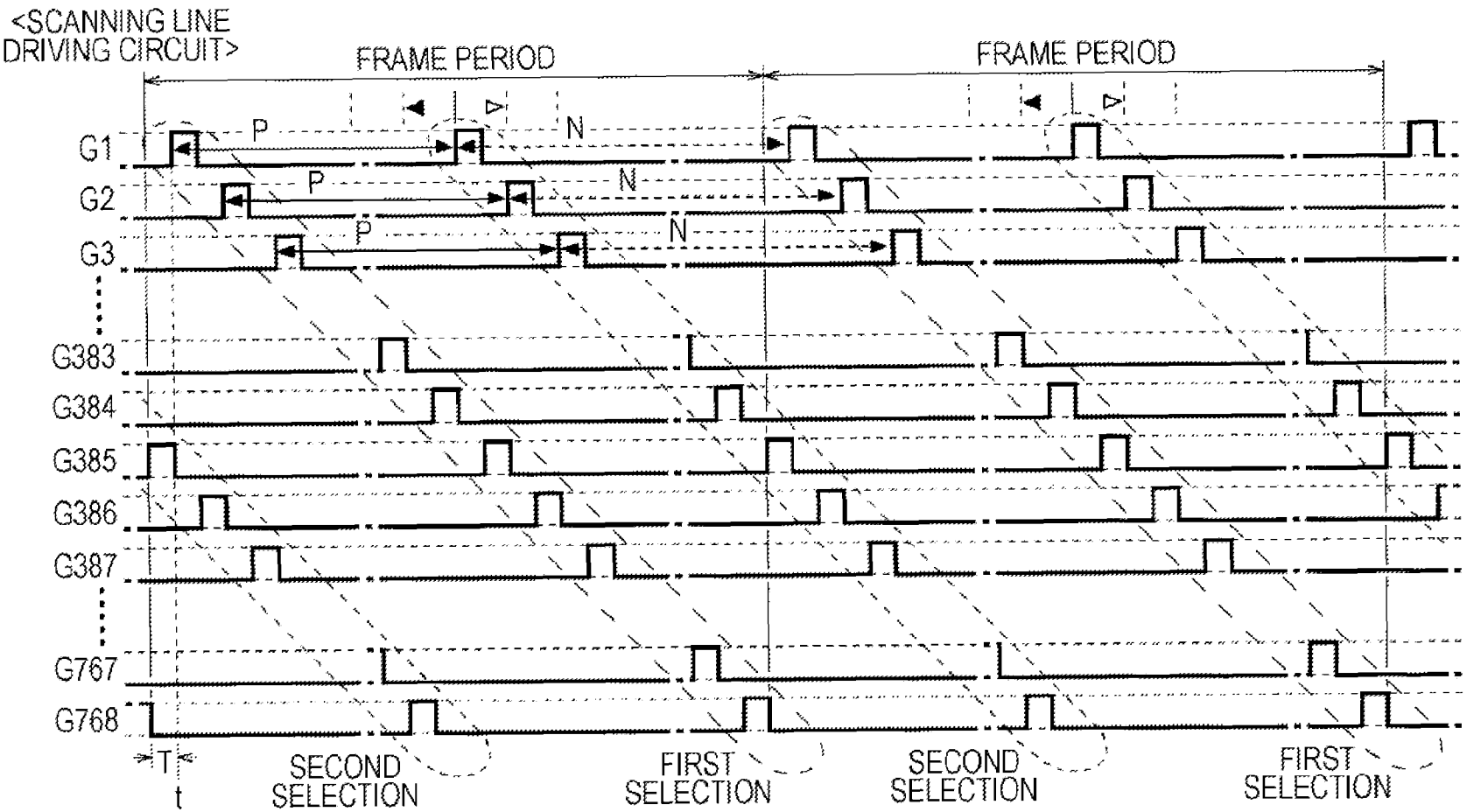
FIG. 9 is a diagram illustrating an operation in a detection adjustment mode in the same liquid crystal display.

In this configuration, in the display mode, under the control of the timing control circuit 202, the scanning line driving circuit 130 firstly selects the scanning lines in an order of 1st, 2nd, 3rd, . . . , and 768th row during a frame period, from the timing t which is delayed by the time T since the start point of the frame period, as shown in FIG. 9. However, the selection period according to the first selection is a half or less compared with that in the first embodiment due to logic operations or the like with other control signals and so on, and there is a temporal gap between the first selections. Next, under the control of the timing control circuit 202, the scanning line driving circuit 130 secondly selects the scanning lines in an order of 1st, 2nd, 3rd, . . . , and 768th row, after a predetermined time has elapsed since the timing t, with the temporal gap as well.

In addition, the data signal conversion circuit 30 has a frame memory therein, converts the data signal ds for the pixels placed in the related scanning lines so as to have the positive polarity upon the first selection, and converts the data signal ds for the pixels placed in the related scanning lines so as to have the negative polarity upon the second selection. Thereby, upon the first selection, the positive voltage is applied to the pixel electrodes 118 via the data lines 114 and is maintained after the related selection, while, upon the second selection, the negative voltage is applied to the pixel electrodes 118 via the data lines 114 and is maintained after the related selection.

When the timing control circuit 202 instructs the scanning line driving circuit 130 to temporally precede the start timing of the second selection, the duration P where the positive voltage is maintained is shortened (the duration N where the negative voltage is maintained is lengthened), whereas when it instructs to temporally delay the start timing thereof, the duration P where the positive voltage is maintained is lengthened (the duration N where the negative voltage is maintained is shortened).

In the display mode, in order to appropriately set a rate of the frame period taken up by the duration P and the duration N, in the second embodiment, in the detection adjustment mode, like the first embodiment, the scanning signals G1 to G768 are all in the H level, and, in this state, the data signals d1 to d1024 are designated as the common voltage Vcom so as to obtain the current zero reference value.

Figures 10A, 10B, 10C, 11:
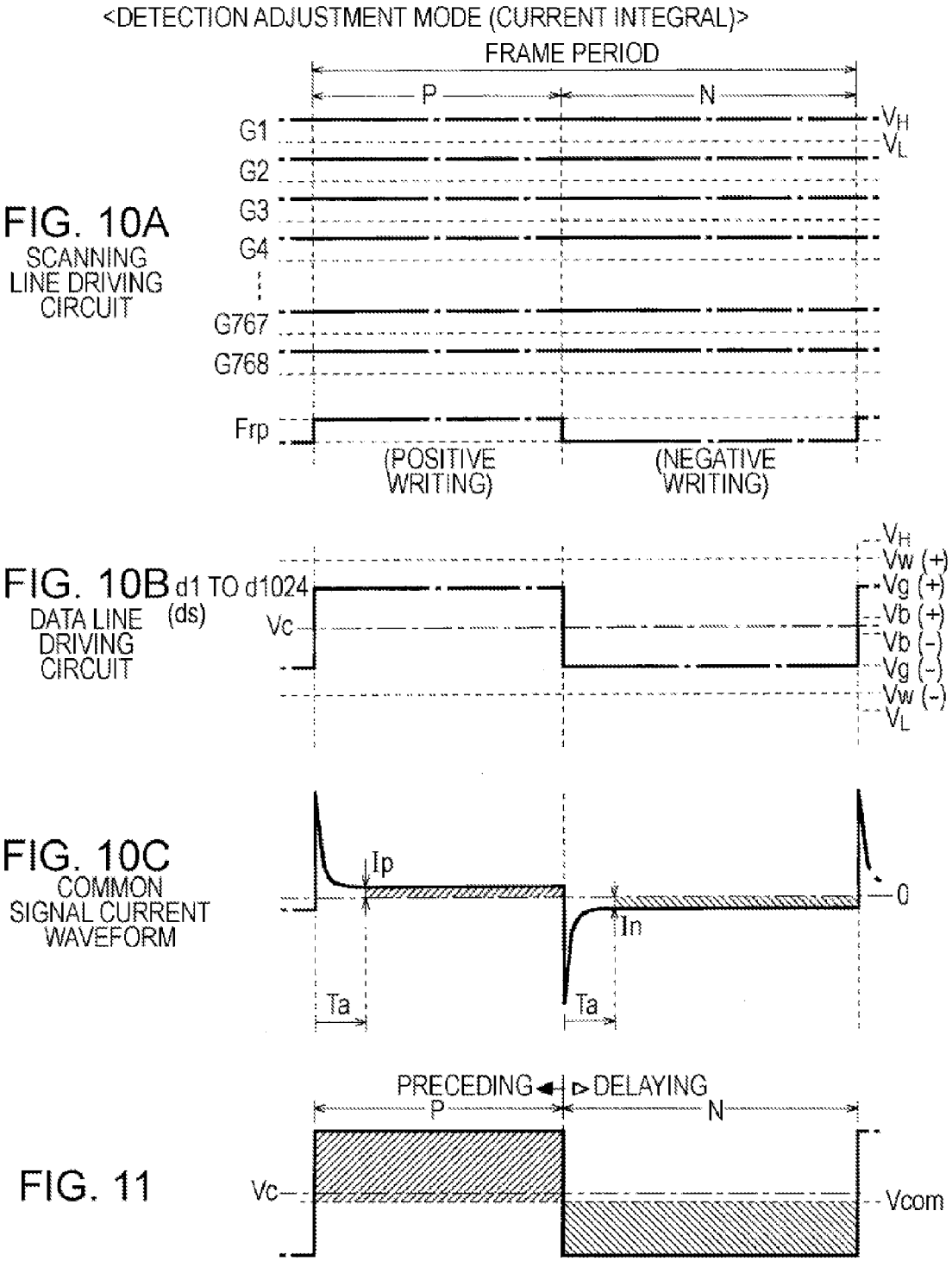
FIGS. 10A to 10C are diagrams illustrating a rate control of a maintaining duration of positive polarity and a maintaining duration of negative polarity.
FIG. 11 is a diagram illustrating a configuration of a liquid crystal display according to a third embodiment.

Next, as shown in FIG. 10A, while the scanning signals G1 to G768 all are in the H level, the frame period is divided into two durations as shown in FIG. 10B, and the data signal ds is designated as the voltage Vg(+) at the former duration P and as the voltage Vg(−) at the latter duration N. The lengths of the durations P and N at this time are designated as, for example, values set in an immediately previous display mode.

Also, in the same manner as the first embodiment, the integral value for the positive current Ip at the duration P and the integral value for the negative current In at the duration N are determined. In detail, the instruction circuit 210, as shown in FIG. 10C, determines the positive current Ip obtained by subtracting the current zero reference value (voltage value) from a current waveform value (voltage waveform value) indicated by the digital data which is input in time series at the duration P. Further, it integrates the corresponding current for an interval from a point in time when the time Ta has elapsed since the start point of the duration P, to an end point of the duration P.

Likewise, the instruction circuit 210 determines the negative current In obtained by subtracting the current zero reference value (voltage value) from a current waveform value (voltage waveform value) indicated by the digital data which is input in time series at the duration N, and, at the same time, integrates the corresponding current for an interval from a point in time when the time Ta has elapsed since the start point of the duration N, to an end point of the duration N.

Here, if the integral value for the positive current and the integral value for the negative value do not lie in the threshold value and also the integral value for the positive current is greater than the integral value for the negative value, the instruction circuit 210 instructs the timing control circuit 202 to temporally precede the start timing of the second selection by one step so as to shorten the duration P (lengthen the duration N), resulting in being located at a position marked with the triangle directing leftwards in FIG. 9 (corresponding to step S8).

Thereby, as marked with the leftward triangle in FIG. 11, the timing control circuit 202 works so that the time period P where the positive voltage is maintained in the liquid crystal elements 120 is shortened.

On the contrary, if the integral value for the positive current and the integral value for the negative value do not lie in the threshold value and also the integral value for the positive current is smaller than the integral value for the negative value, the instruction circuit 210 instructs the timing control circuit 202 to temporally delay the start timing of the second selection by one step so as to lengthen the duration P (shorten the duration N), resulting in being located at a position marked with the triangle directing rightwards in FIG. 9 (corresponding to step S9).

Thereby, as marked with the rightward triangle in FIG. 11, the timing control circuit 202 works so that the duration P where the positive voltage is maintained in the liquid crystal elements 120 is lengthened.

The instruction circuit 210 repeatedly performs such an instruction until the integral value for the positive current and the integral value for the negative value lie in the threshold value. When they lie in the threshold value, the operation mode is transferred to the display mode, and the start timing of the second selection is set to a point in time where they lie in the threshold value.

Therefore, also in the second embodiment, when transferred to the display mode after finishing the detection adjustment mode, the rate of the duration P where the positive voltage is maintained and the duration N where the negative voltage is maintained is appropriately controlled, thereby suppressing the application of a DC component to the liquid crystal layer 105. For this reason, also in the second embodiment, it is possible to suppress the application of a DC component to the liquid crystal layer 105 and to reduce flicker with high accuracy, without employing a light sensing element.

Also, in the second embodiment, in the detection adjustment mode, there is no need of making currents flow through all the liquid crystal elements 120, for example, the scanning lines in odd rows are selected, and currents (or integral value) flowing through a half of the liquid crystal elements 120 may be determined.

Further, in the second embodiment as well, instead of the integral value, the currents Ip and In may be detected and compared with each other at the related point in time. Here, if the positive current Ip is greater than the negative current In in view of an absolute value, the control may be made so as to shorten the duration P where the positive voltage is maintained (so as to lengthen the duration N where the negative voltage is maintained), and, in contrast, if the positive current Ip is smaller than the negative current In in view of an absolute value, the control may be made so as to lengthen the duration P (so as to shorten the duration N).

Third Embodiment

The third embodiment of the invention will be described. The liquid crystal elements 120 used to detect the current are also used to perform a display operation in the first and second embodiments; however, the liquid crystal elements are only used for detection (i.e., detection only) in the third embodiment.

Figure 12:
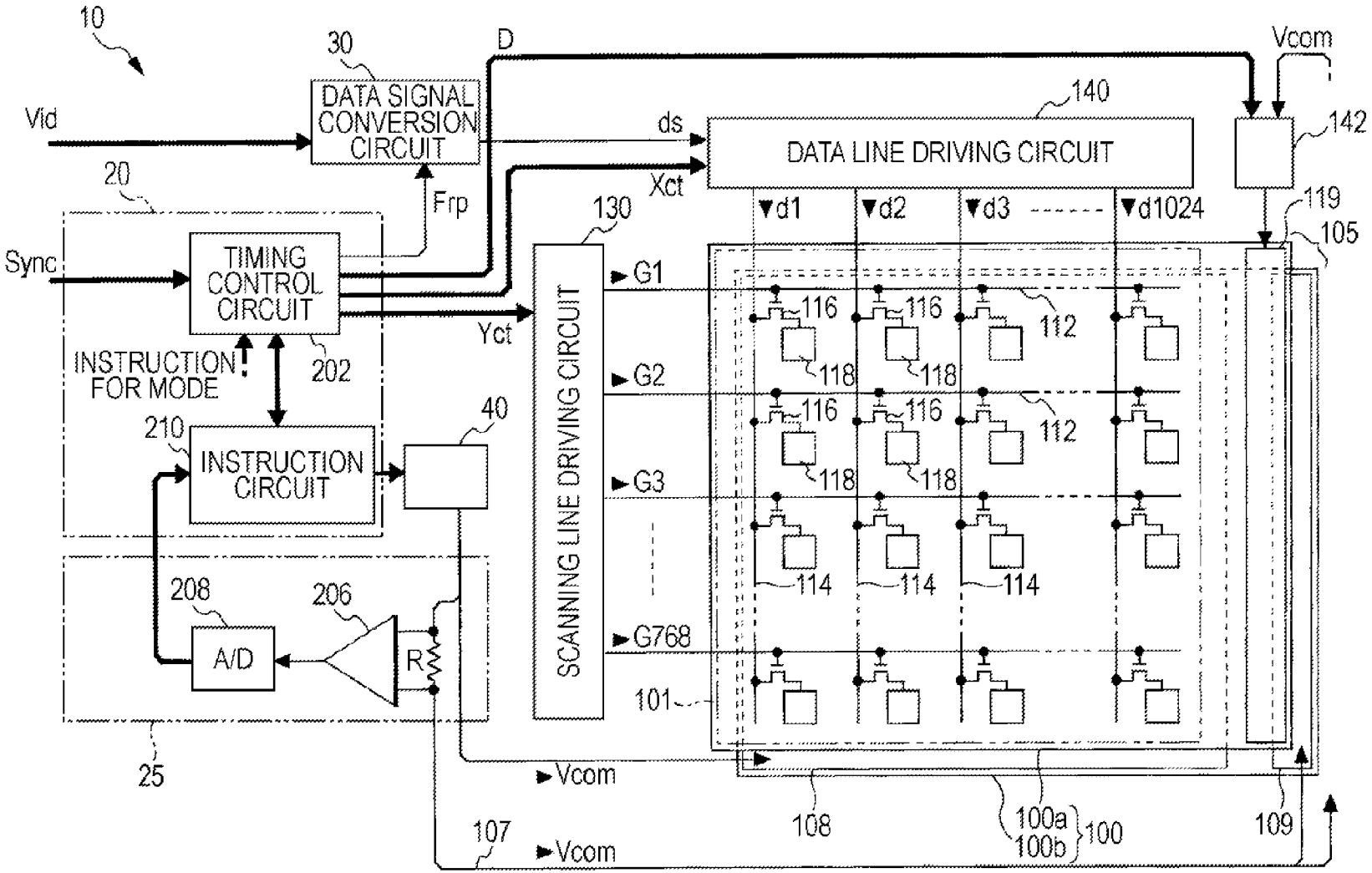
FIG. 12 is a diagram illustrating a rate control of a maintaining duration of positive polarity and a maintaining duration of negative polarity.

As shown in FIG. 12, in the third embodiment, a first electrode 119 with a tetragonal shape, is provided outside the display area 101 on the rear face of the element panel 100*a*, and a second electrode 109 is provided on the opposite panel 100*b* so as to face the first electrode 119.

Thereby, the liquid crystal layer 105 is sandwiched by the first electrode 119 and the second electrode 109, and this is the same as the liquid crystal elements 120 in which the liquid crystal layer 105 is sandwiched by the pixel electrodes 118 and the common electrode 108. However, the liquid crystal elements in which the liquid crystal layer 105 is sandwiched by the first electrode 119 and the second electrode 109 is placed outside the display area 101, and thus is not recognized.

In the third embodiment, in response to the control signal D from the timing control circuit 202, the electrode driving circuit 142 supplies, for the first electrode 119, the same signal as the data signal ds in the detection adjustment mode in the first embodiment. In addition, the common electrode driving circuit 40 applies the common voltage Vcom, to the common electrode 108 via one signal line of two signals divided on the way, and to the second electrode 109 via the other signal line 107. The resistor R is interposed in the signal line 107 transmitting the common voltage Vcom to the second electrode 109.

Also, in the example shown in FIG. 12, the liquid crystal elements 120 placed in the display area 101 are driven in the display mode, and the liquid crystal elements 120 placed outside the display area 101 are driven in the detection adjustment mode. The instruction circuit 210 instructs an increase or decrease of the common value Vcom applied to the common electrode 108 so that the integral value for the positive current and the integral value for the negative value detected by the detection circuit 25 lie in the threshold value. Thus, in the example shown in FIG. 12, the electrode driving circuit 142 and the common electrode driving circuit 40 are circuits which drive the liquid crystal elements in which the liquid crystal layer 105 is sandwiched by the first electrode 119 and the second electrode 109.

In the same manner as the second embodiment, in the third embodiment, the instruction circuit 210 may instruct the timing control circuit 202 to increase or decrease the rate of the duration P and the duration N in the liquid crystal elements 120 placed in the display area 101, so that the integral value for the positive current and the integral value for the negative value, which have been obtained, lie in the threshold value.

In the third embodiment, the liquid crystal elements used to detect the current are disposed independently from the liquid crystal elements 120 placed in the display area 101. Thus, it is possible to enable the liquid crystal elements 120 in the display area 101 to perform a display operation based on the video signal Vid, and, at the same time, to enable the liquid crystal elements in which the liquid crystal layer 105 is sandwiched by the first electrode 119 and the second electrode 109 to perform a current detection operation.

That is to say, in the third embodiment, even when the liquid crystal elements 120 placed in the display area 101 are driven in the display mode, the liquid crystal elements 120 placed outside the display area 101 can be driven in the detection adjustment mode.

Therefore, in the third embodiment, the effect that flicker component is reduced without employing a light sensing element by suppressing the application of DC component to the liquid crystal layer 105 can be achieved without having any influence on visible images.

Although the current flowing through the signal line 107 has been detected by converting it into the voltage by using the resistor R in the respective embodiments, the current may be detected by any other configurations. For example, the related current may be detected by using an intensity of magnetic field generated by a flowing current like in a hole device, a current transformer, or the like.

In the respective embodiments, the liquid crystal elements 120 are not limited to a transmissive type, but may be a reflective type; also, not limited to a normally black mode, but may be a normally white mode.

Electronic Device

Figure 13:
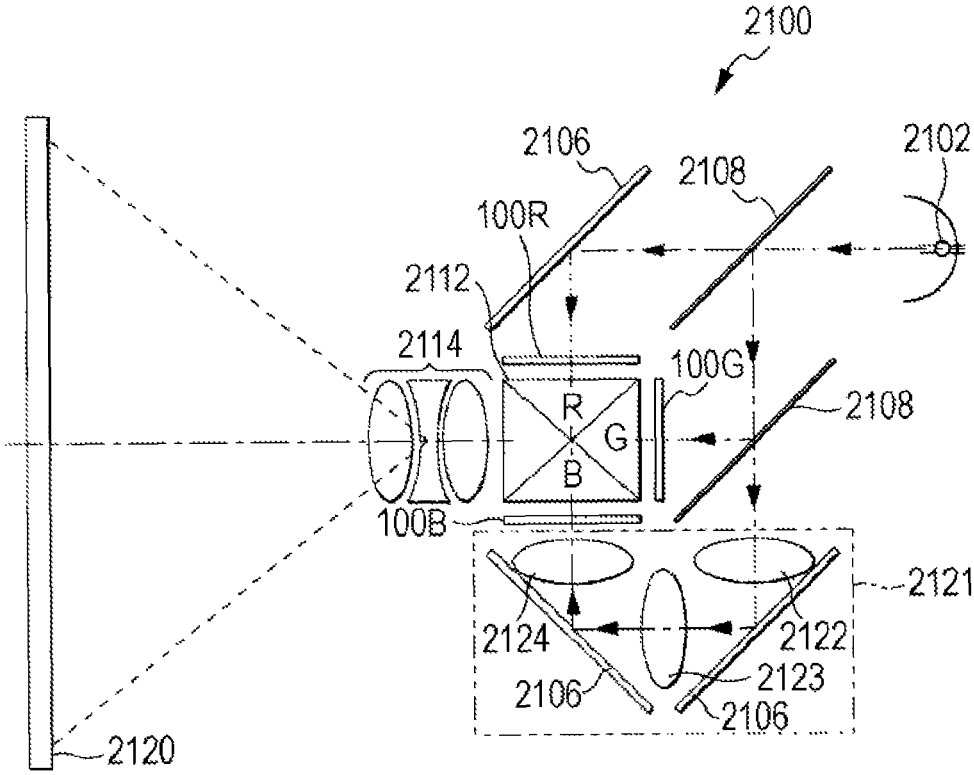
FIG. 13 is a diagram illustrating a projector employing the liquid crystal display according to the embodiments.

As an example of an electronic device employing the LCD according to the above-described embodiments, a projector which uses the panel assembly 100 as a light valve will be described. FIG. 13 is a plan view illustrating a configuration of the projector.

As shown in this figure, a lamp unit 2102 including a white light source such as a halogen lamp or the like is provided in the projector 2100. Light emitted from the lamp unit 2102 is divided into light components of three primary colors, R (red) color, G (green) color, and B (blue) color, by three mirrors 2106 and two dichroic mirrors 2108 disposed in its inner side, and they are respectively guided to light valves 100R, 100G and 100B corresponding to the respective primary colors. The light of B color has a longer light path than the light of R color or G color, and thus, for prevention of its loss, it is guided to a relay lens system 2121 including a light-incident lens 2122, a relay lens 2123, and a light-exciting lens 2124.

In this projector 2100, the LCD having the panel assembly 100 is provided in three sets corresponding to the respective R color, G color and B color. Each of the light valves 100R, 100G and 100B has the same configuration as the above-described panel assembly 100. A video signal corresponding to each primary color of R color, G color and B color is supplied from an external device, to drive the light valves 100R, 100G and 100B, respectively.

The light components respectively modulated by the light valves 100R, 100G and 100B are incident to a dichroic prism 2112 in three directions. In this dichroic prism 2112, the light components of R color and B color are refracted by 90 degrees, whereas the light of G color travels straight. Thereby, images of the respective primary colors are combined, and then a color image is projected on a screen 2120 by a projection lens 2114.

Since the light components respectively corresponding to R color, G color and B color are incident to the light valves 100R, 100G and 100B by the dichroic mirror 2108, color filters are not required. In addition, the transmission images from the light valves 100R and 100B are projected after reflected from the dichroic prism 2112, whereas the transmission image from the light valve 100G is projected as it is, and thus the horizontal scanning direction for the light valves 100R and 100B is made to be optimally reverse to that for the light valve 100G, so as to display bilaterally inverted images.

As the electronic device, in addition to the projector described referring to FIG. 13, there are, for example, a television set, a view finder type monitor/direct view type video tape recorder, a car navigation device, a pager, an electronic diary, an electronic calculator, a word processor, a workstation, a television-phone, a POS terminal, a digital still camera, a mobile phone, and a device having a touch panel, and so forth. It is apparent that the above-described electro-optical device is applicable to the various kinds of electronic devices.

The entire disclosure of Japanese Patent Application No. 2009-133789, filed Jun. 3, 2009 is expressly incorporated by reference herein.

What is claimed is:

1. A liquid crystal display comprising:

a liquid crystal element in which a liquid crystal layer is sandwiched by a first electrode and a second electrode;

a driving circuit configured to apply, between the first electrode and the second electrode, a voltage for resetting a voltage maintained in the liquid crystal element and thereafter to apply, to the first electrode, a voltage higher than a predetermined voltage and a voltage lower than the predetermined voltage at different timings;

a detection circuit configured to detect a current flowing through the second electrode;

a comparison circuit configured to designate, as a reference value, the current flowing through the second electrode when the voltage maintained in the liquid crystal element is reset, to specify a first current which is obtained by excluding a charging current due to application of a related higher voltage from currents flowing through the second electrode when the higher voltage is applied to the first electrode, and a second current which is obtained by excluding a charging current due to application of a related lower voltage from currents flowing through the second electrode when the lower voltage is applied to the first electrode, and to compare the first current with the second current; and a control circuit configured to control the first current and the second current based on the comparison result, wherein the first electrode is a pixel electrode which is coupled to a data line via a switching element turned on when a scanning line is selected; and the second electrode is a common electrode, wherein the driving circuit comprises:

a scanning line driving circuit selecting the scanning line;

a data line driving circuit supplying a data signal for the data line at the selection period; and a common electrode driving circuit supplying the common voltage for the common electrode;

wherein the comparison circuit is configured to compare an integral value for the first current with an integral value for the second current and integrate the first current and the second current for a portion of a vertical scanning period.

2. The liquid crystal display according to claim 1, wherein the driving circuit is configured to apply the same voltage to the first electrode and the second electrode, as the voltage for resetting a voltage maintained in the liquid crystal element.

3. The liquid crystal display according to claim 2, wherein the control circuit is configured to specify, as the first current or the second current, a current flowing through the second electrode after a predetermined time has elapsed since the higher voltage or the lower voltage is applied.

4. The liquid crystal display according to claim 1, wherein the control circuit is configured to increase or decrease the common voltage based on the comparison result.

5. The liquid crystal display according to claim 1, wherein the control circuit configured to alter a duration where the higher voltage is maintained in the pixel electrode and a duration where the lower voltage is maintained in the pixel electrode, based on the comparison result.

6. The liquid crystal display according to claim 1, wherein the detection circuit comprises a resistor interposed in a signal line transmitting the predetermined voltage to the second electrode; and a voltage amplification circuit amplifying a voltage across the resistor, wherein the detection circuit is configured to detect the voltage amplified by the voltage amplification circuit as the current flowing through the second electrode.

7. The liquid crystal display according to claim 1, wherein the detection circuit is configured to detect a current flowing through the second electrode of the liquid crystal element placed in an area other than a display area.

8. An electronic device comprising any one of the liquid crystal displays according to claim 1.

* * * * *